US008200127B2

(12) United States Patent
Nozawa

(10) Patent No.: US 8,200,127 B2
(45) Date of Patent: Jun. 12, 2012

(54) DEVELOPER STORING CONTAINER AND IMAGE FORMING APPARATUS

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 618 days.

(21) Appl. No.: 12/320,319

(22) Filed: Jan. 23, 2009

(65) Prior Publication Data

US 2009/0190963 A1 Jul. 30, 2009

(30) Foreign Application Priority Data

Jan. 24, 2008 (JP) ..... 2008-013556

(51) Int. Cl.
*G03G 15/08* (2006.01)

(52) U.S. Cl. ..... 399/262; 399/110

(58) Field of Classification Search ..... 399/262, 399/110

See application file for complete search history.

(56) References Cited

U.S. PATENT DOCUMENTS

| | | | | |
|---|---|---|---|---|
| 6,324,371 | B1 | 11/2001 | Okiyama et al. | |
| 6,782,222 | B2 * | 8/2004 | Ito et al. | 399/111 |
| RE40,711 | E * | 5/2009 | Okiyama et al. | 399/262 |
| 7,965,957 | B2 * | 6/2011 | Kubota et al. | 399/119 |
| 2003/0031479 | A1 * | 2/2003 | Ito | 399/27 |
| 2006/0280526 | A1 | 12/2006 | Shimomura | |
| 2006/0280527 | A1 | 12/2006 | Lee | |
| 2007/0065184 | A1 * | 3/2007 | Sato | 399/262 |
| 2008/0075506 | A1 * | 3/2008 | Sato | 399/262 |
| 2008/0175627 | A1 * | 7/2008 | Sato | 399/254 |
| 2009/0238609 | A1 * | 9/2009 | Koido | 399/262 |

FOREIGN PATENT DOCUMENTS

| | | |
|---|---|---|
| EP | 0 905 577 A2 | 3/1999 |
| JP | 60-130772 | 7/1985 |
| JP | 2001-042620 | 2/2001 |
| JP | 2006-343560 | 12/2006 |

* cited by examiner

*Primary Examiner* — David Gray
*Assistant Examiner* — G. M. Hyder
(74) *Attorney, Agent, or Firm* — Rabin & Berdo, P.C.

(57) ABSTRACT

A developer storing container includes outer and inner cases. The outer case includes first and second hollow portions. The first hollow portion includes a surrounding wall so shaped as to surround a center axis. The surrounding wall has both ends in a cross-section perpendicular to the center axis, and has an ejection opening. The second hollow portion includes first and second outer walls extending from both ends of the surrounding wall and a third outer wall disposed therebetween. The inner case is rotatably disposed in the first hollow portion, and has an opening corresponding to the ejection opening. The surrounding wall extends from one of both ends to the other of both ends at an angle greater than or equal to 180 degrees with respect to the center axis. An entire outer surface of the surrounding wall constitutes a part of an outer surface of the outer case.

22 Claims, 15 Drawing Sheets

DEVELOPER STORING CONTAINER AND IMAGE FORMING APPARATUS

BACKGROUND OF THE INVENTION

The present invention relates to a developer storing container and an image forming apparatus using the developer storing container.

A developer storing container is detachably mounted to a developing device of an electrophotographic image forming apparatus for supplying a developer to the developing device. Conventionally, such a developer storing container includes an outer case and an inner case. The outer case includes a polygonal portion having a polygonal cross-section and an arc-shaped portion having an arc-shaped cross section. The inner case is provided in the arc-shaped portion of the outer case so as to be rotatable contacting an inner surface of the arc-shaped portion. The arc-shaped portion has a lower ejection opening for supplying the developer to the developing device. A seal member is fixed to the inner case, which is pressed against the inner surface of the arc-shaped portion around the lower ejection opening-to entirely seal the lower ejection opening.

When a user mounts the developer storing container to the developing device, the user holds the polygonal portion of the developer storing container, and sets the developer storing container in the developing device. Thereafter, the user operates an operation lever (disposed on an end of the inner case in the longitudinal direction) to rotate the inner case in the arc-shaped portion of the outer case so as to open the lower ejection opening. With this, the developer is supplied to the developing device via the lower ejection opening. In this state, the seal member has slid in a direction away from the lower ejection opening along the inner surface of the arc-shaped portion according to the rotation of the inner case. Such a developer storing container is disclosed in, for example, Japanese Laid-open Patent Publication No. 2001-42620 (Page 4, FIG. 2).

SUMMARY OF THE INVENTION

The present invention is intended to provide a developer storing container and an image forming apparatus capable of preventing leakage of a developer when applied with an external force without increasing a rotational load of an inner case.

The present invention provides a developer storing container including an outer case and an inner case. The outer case includes a first hollow portion and a second hollow portion. The first hollow portion includes a surrounding wall so shaped as to surround a center axis. The surrounding wall has both ends in a cross-section perpendicular to the center axis. The surrounding wall has an ejection opening through which a developer is ejected. The second hollow portion includes plate-shaped first and second outer walls respectively extending from the both ends of the surrounding wall and a third outer wall disposed between the first and second outer walls. The inner case is rotatably disposed in the first hollow portion contacting an inner surface of the surrounding wall. The inner case has an opening that faces the ejection opening when the inner case is in a predetermined rotational position. The surrounding wall extends from one of both ends to the other of both ends at an angle greater than or equal to 180 degrees with respect to the center axis. An entire outer surface of the surrounding wall constitutes a part of an outer surface of the outer case.

With such an arrangement, even when the outer case deforms under an external force (for example, when a user grips a second storing portion of the outer case of the developer storing container for mounting the developer storing container into a developing unit main body), the deformation causes a pressing force that presses the inner case toward the ejection opening. Therefore, it possible to prevent leakage of the developer stored in the developer storing container.

The present invention also provides a developer storing container including a first storing portion in which a developer can be stored. The first storing portion is surrounded by a first surrounding wall having a substantially uniform cross-section. The first surrounding wall has an ejection opening through which the developer is ejected. The developer storing container further includes a second storing portion in which the developer can be stored. The second storing portion is surrounded by a second surrounding wall having a substantially uniform cross-section. The second storing portion is connected to the first storing portion. A shutter is disposed so as to open and close the ejection opening. At a connecting portion between the first storing portion and the second storing portion, the first surrounding wall and the second surrounding wall are constricted inwardly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings.

Embodiment 1.

Figure 1:
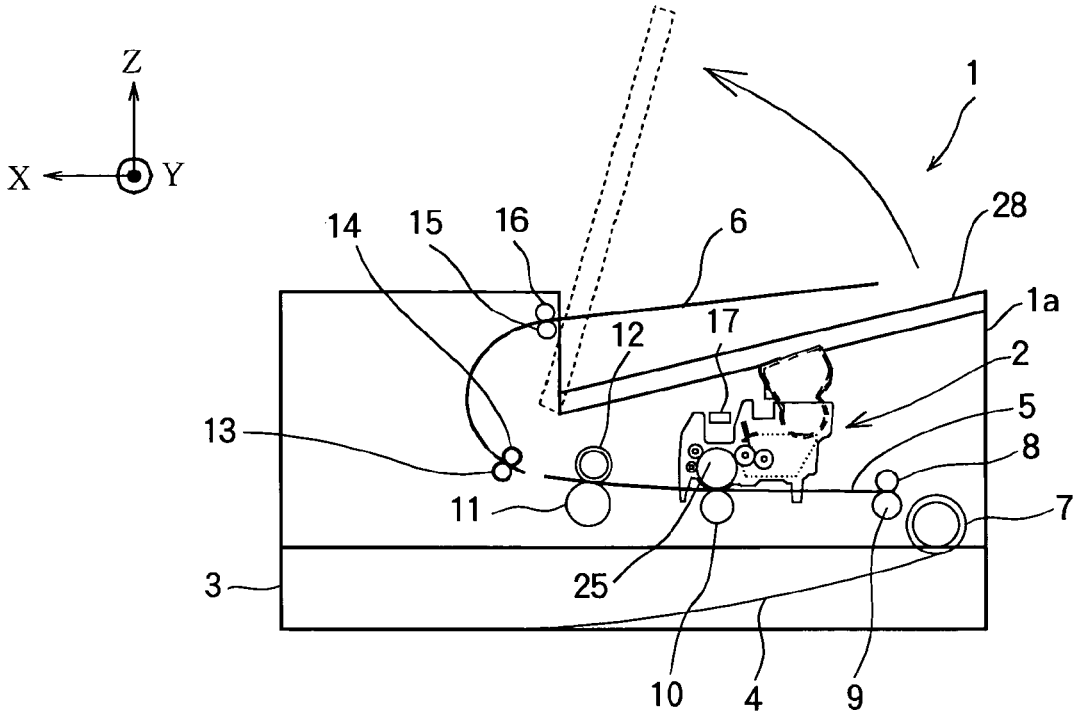
FIG. 1 is a schematic view showing a configuration of an image forming apparatus to which a developer storing container according to Embodiment 1 of the present invention is applied.

FIG. 1 is a schematic view showing a configuration of an image forming apparatus employing a developer storing container according to Embodiment 1 of the present invention.

As shown in FIG. 1, an image forming apparatus 1 is configured as an electrophotographic printer capable of printing an image of, for example, black (K) on a recording sheet 4 (i.e., a medium). The image forming apparatus 1 has a sheet feeding path along which the recording sheet 4 is fed. A sheet feeding cassette 3 for storing the recording sheets 4 is mounted to a lower part of the image forming apparatus 1, and defines an upstream end of the sheet feeding path. A stacker 28 is formed on a cover 1*a* of the image forming apparatus 1, and defines a downstream end of the sheet feeding path. Between the sheet feeding cassette 3 and the stacker 28, a pair of registration rollers 8 and 9, a pair of ejection rollers 13 and 14 and another pair of ejection rollers 15 and 16 are disposed along the sheet feeding path.

A hopping roller 7 is disposed in the vicinity of the sheet feeding cassette 3 for feeding the recording sheet 4 to the sheet feeding path one by one. The registration rollers 8 and 9 are disposed on the downstream side of the hopping roller 7 and are configured to correct skew of the recording sheet 4 and feed the recording sheet 4 at a predetermined timing. A developing unit 2 and a transfer roller 10 are disposed on the downstream side of the registration rollers 8 and 9. The developing unit 2 includes a photosensitive drum 25 on which a toner image is formed. The transfer roller 10 is disposed so as to sandwich the recording sheet 4 between the transfer roller 10 and the photosensitive drum 25 to transfer the toner image to the recording sheet 5. A fixing unit for fixing the toner image to the recording sheet 5 is disposed on the downstream side of the developing unit 2 and the transfer roller 10, and includes a heat roller 12 and a backup roller 11. The ejection rollers 13, 14, 15 and 16 eject the recording sheet 6 (to which the toner image has been fixed) to the stacker 28 outside the image forming apparatus 1. In the above description, the recording sheet has been described with different reference numerals 4, 5 and 6 according to stages of feeding.

In FIG. 1, X-direction, Y-direction and Z-direction are defined as follows. The X-direction is defined as a feeding direction of the recording sheet 5 when the recording sheet 5 passes the developing unit 2. The Y-direction is defined as a direction of a rotational axis of the photosensitive drum 25. The Z-direction is defined as being perpendicular to both of the X-direction and Y-direction. The X-direction, Y-direction and Z-direction in other figures indicate the same directions as those shown in FIG. 1. In other words, the X-direction, Y-direction and Z-direction of the respective figures indicate orientations of respective parts shown in the figures when the parts constitute the image forming apparatus 1 shown in FIG. 1.

Figure 2:
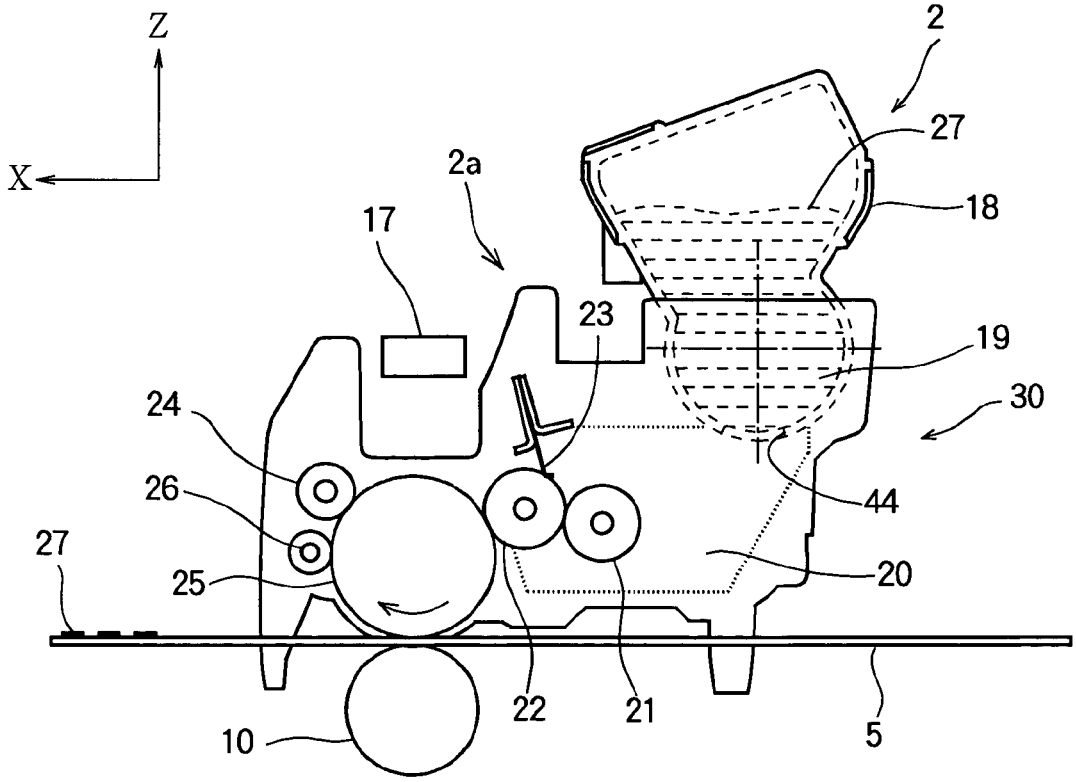
FIG. 2 is a schematic view showing a developing unit together with a transfer roller, an exposing device and a recording sheet.

FIG. 2 is a schematic view showing the developing unit 2 together with the transfer roller 10, an exposing device 17 and a recording sheet 5.

As shown in FIG. 2, the developing unit 2 includes the photosensitive drum 25 that bears an electric charge on a circumferential surface thereof in such a manner that the electric charge is removed by exposure. The photosensitive drum 25 rotates in a direction shown by an arrow in FIG. 2. The photosensitive drum 25 has a structure in which, for example, a semiconductive rubber such as epichlorohydrin rubber is formed around a conductive metal shaft in the form of a roller.

Along the circumference of the photosensitive drum 25, a charging roller 24 and an exposing device 17 are disposed in this order in the rotational direction of the photosensitive drum 25. The charging roller 24 is pressed against the surface of the photosensitive drum 25 at a constant pressure and supplies electric charge to the surface of the photosensitive drum 25. The exposing device 17 is disposed on the main body of the image forming apparatus (FIG. 1), and is composed of, for example, an LED head that exposes the charged surface of the photosensitive drum 25 to form a latent image.

On the downstream side of the exposing device 17 along the rotational direction of the photosensitive drum 25, a developing portion 30 and a cleaning roller 26 are disposed. The developing portion 30 causes a toner (i.e., a developer) 27 of a predetermined color (in this example, black) to the surface of the photosensitive drum 25 (on which the latent image is formed) to thereby form a toner image. The cleaning roller 26 removes a residual toner that remains on the surface of the photosensitive drum 25 after the toner image is transferred to the recording sheet 5 by the transfer roller 10.

The developing portion 30 includes a developer storing container 18, a toner holding space 20, a developing roller 22, a toner supplying roller 21, and a developer layer regulating member 23. The developer storing container 18 has a toner storing space 19 in which a toner 27 as an unused developer is stored. A lower ejection opening 44 in the form of an elongated hole is formed on the bottom of the toner storing space 19 through which the toner 27 in the toner storing space 19 is supplied. The toner holding space 20 stores the toner 27 supplied by the developer storing container 18. The developing roller 22 is disposed in contact with the photosensitive drum 25. The toner supplying roller 21 supplies the toner 27 to the developing roller 22. The developer layer regulating member 23 forms a thin layer of the toner 27 having a uniform thickness on the surface of the developing roller 22. With such a configuration, the developing portion 30 develops the latent image on the photosensitive drum 25 by causing the toner 27 to adhere to the latent image. In this regard, an inner case 50 (see FIG. 4) for opening and closing the lower ejection opening 44 is omitted in FIG. 2 for convenience of illustration.

The developing roller 22, the toner supplying roller 21 and the developer layer regulating member 23 are electrically connected to a developing roller power source (not shown), a supplying roller power source (not shown) and a developer layer regulating member power source (not shown) and are applied with respective bias voltages. The developing roller 22 has a structure in which, for example, a semiconductive rubber of silicone or the like is formed around a conductive metal shaft in the form of a roller. The toner supplying roller 21 has a structure in which, for example, a rubber (to which a foaming agent has been added in a kneading process for enhancing conveying performance) is formed around a conductive metal shaft in the form of a roller.

The developing unit 2 is so configured that the developer storing container 18 is detachably disposed above the toner holding space 20 as described later. A part of the developing unit 2 except the detachable developer storing container 18 is referred to as a developing unit main body 2*a*. The developing unit main body 2*a* has a toner replenishing opening (not shown) disposed on a position facing the lower ejection opening 44 of the developer storing container 18, for receiving the toner 27 supplied by the developer storing container 18.

As shown in FIGS. 1 and 2, the transfer roller 10 is disposed facing the photosensitive drum 25 of the developing unit 2. The transfer roller 10 is composed of a conductive rubber or the like. The transfer roller 10 and the photosensitive drum 25 sandwich a not shown transfer belt that electrostatically absorbs and feeds the recording sheet 5. The transfer roller 10 transfers the toner image formed on the photosensitive drum 25 to the recording sheet 5. For this purpose, the transfer roller 10 is applied with an electric potential so that a predetermined potential difference is formed between the surface potential of the photosensitive drum 25 and the surface potential of the transfer roller 10.

The fixing unit (FIG. 1) includes the heat roller 12 and the backup roller 11 and fixes the toner 27 (having been transferred to the recording sheet 5 as shown in FIG. 2) to the recording sheet 5 by pressing and heating the toner 27.

A cover 28 is disposed on an upper surface of the image forming apparatus 1. The cover 28 is swingable so as to be opened and closed. When the cover 28 is opened, the developer storing container 18 can be detached from and mounted to the developing unit main body 2*a* in the image forming apparatus 1.

Figure 3B:
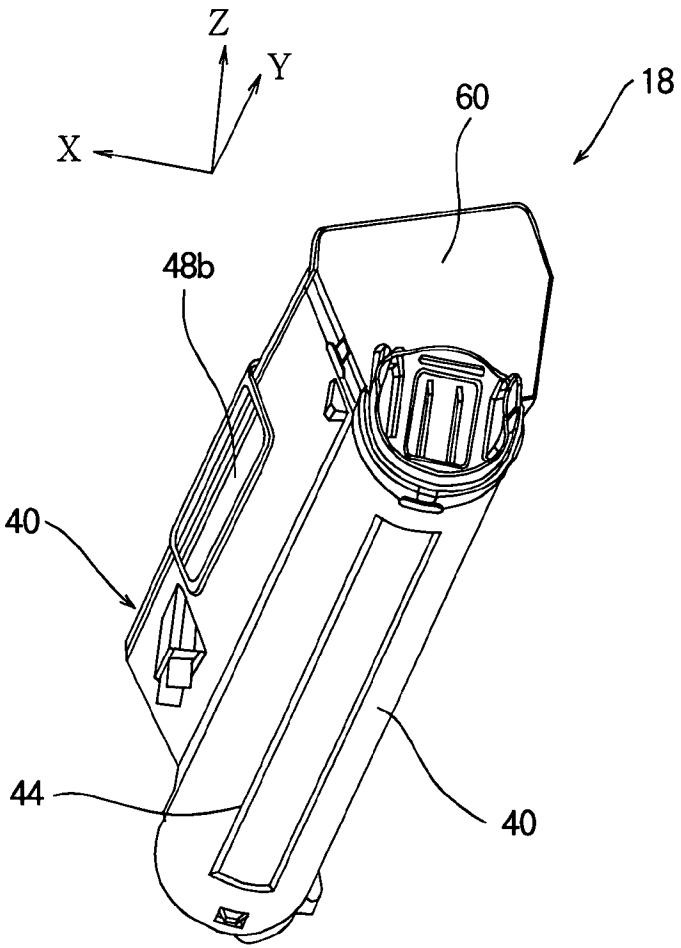
FIGS. 3A and 3B are bottom perspective views showing the developer storing container according to Embodiment 1 as seen from different directions.
Figure 3A:
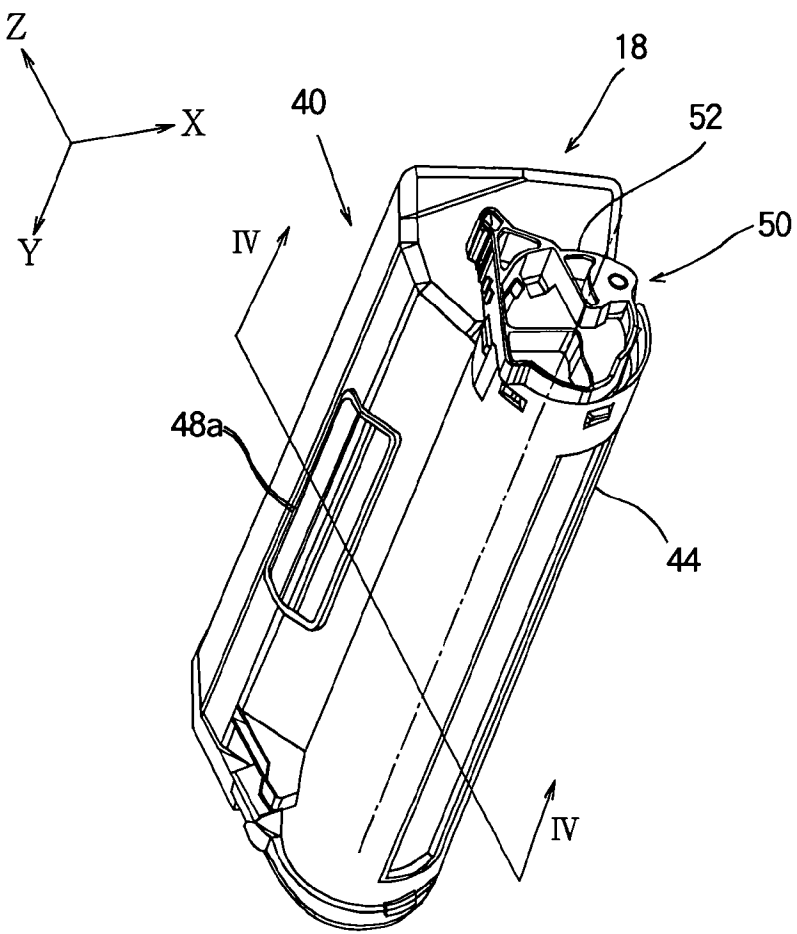
Figure 4A:
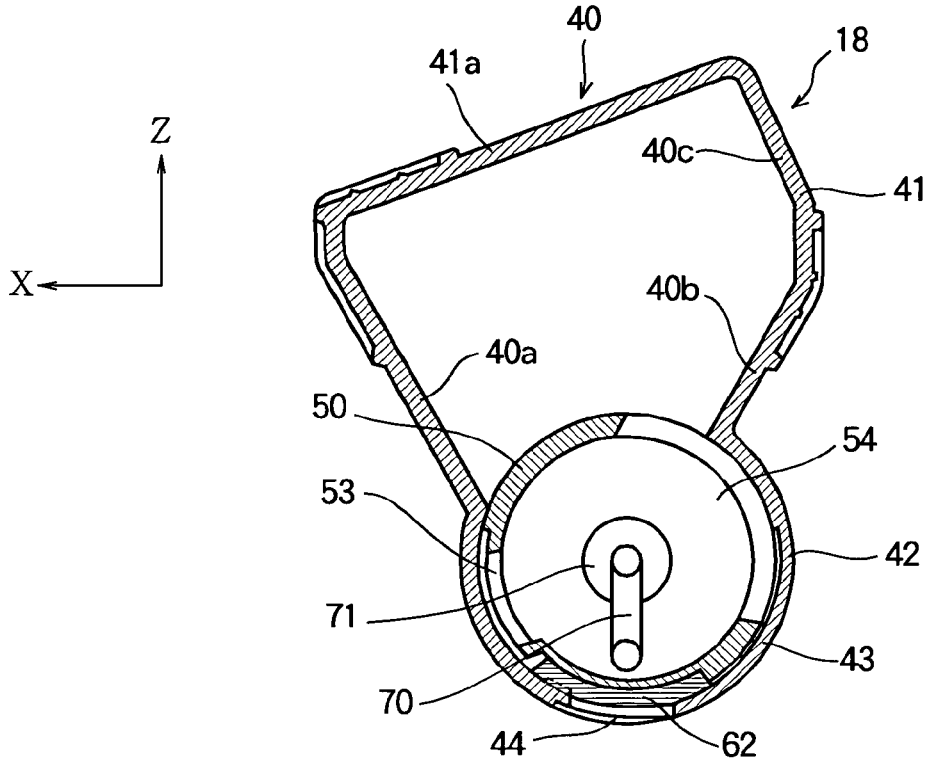
FIG. 4A is a sectional view showing the developer storing container according to Embodiment 1 taken along line IV-IV in FIG. 3 in a state where a lower ejection opening is closed.
Figure 4B:
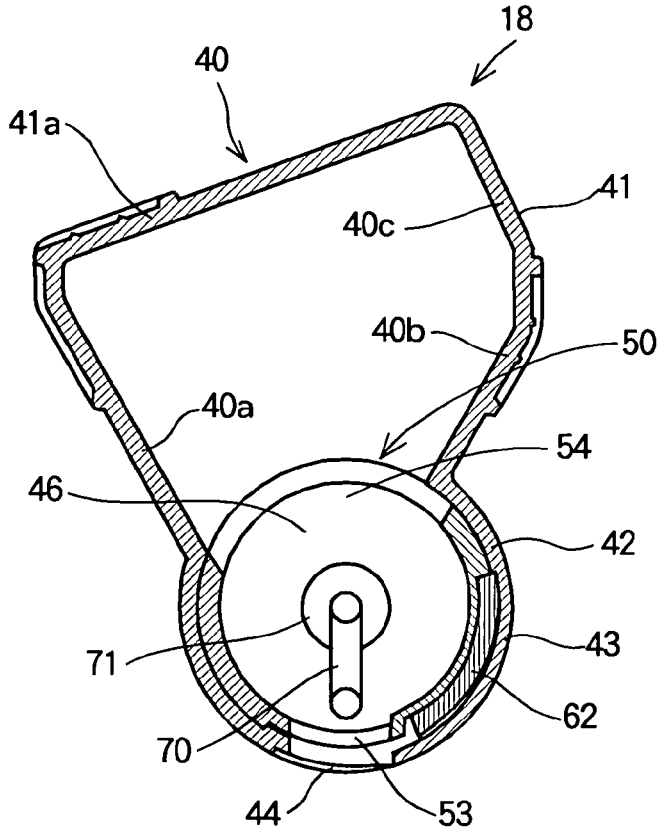
FIG. 4B is a sectional view showing the developer storing container according to Embodiment 1 taken along line IV-IV in FIG. 3 in a state where a lower ejection opening is opened.
Figure 5:
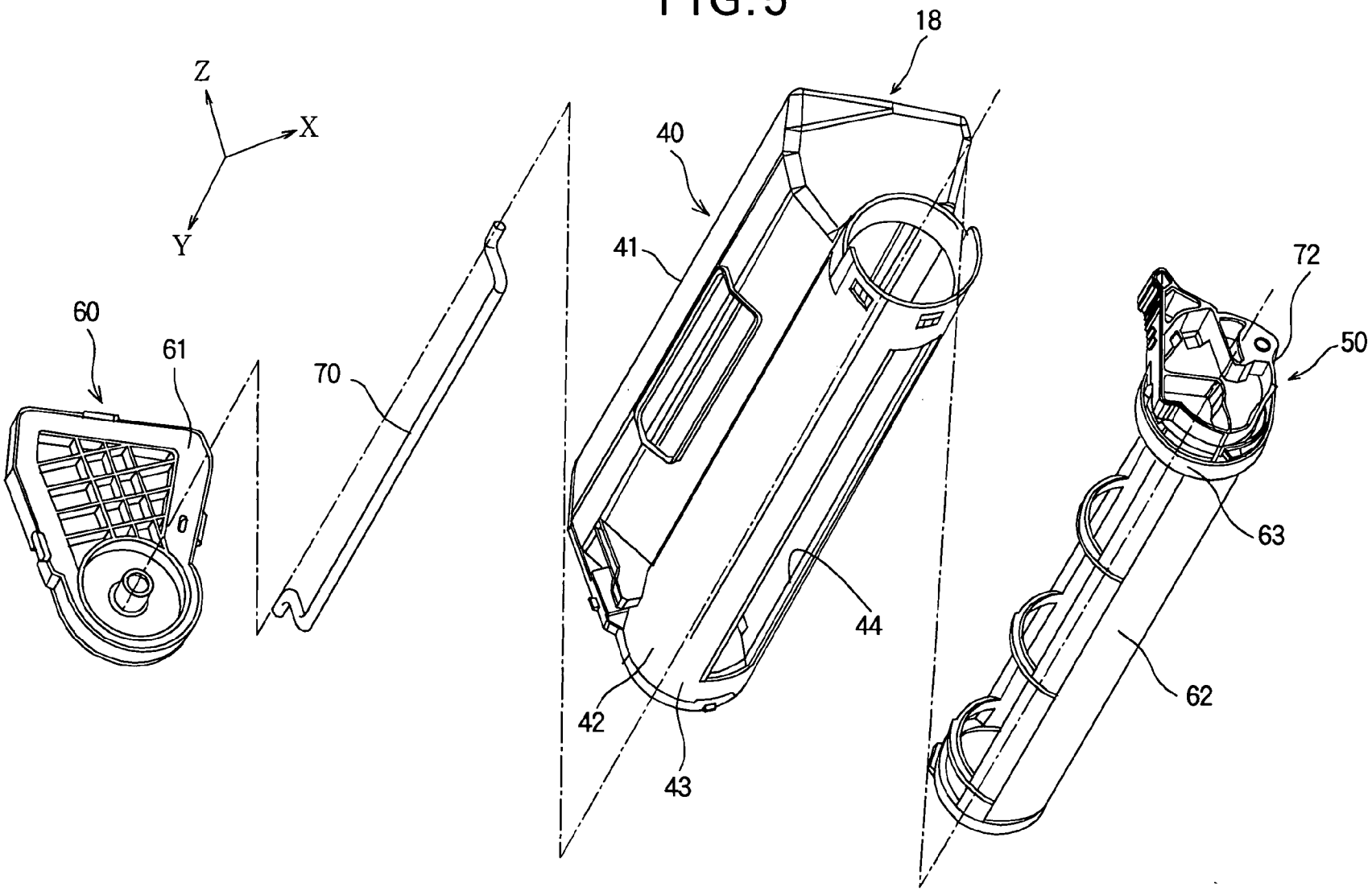
FIG. 5 is an exploded perspective view showing the developer storing container according to Embodiment 1 as seen in substantially the same direction as FIG. 3A.

FIGS. 3A and 3B are bottom perspective views of the toner storing container 18 as seen in opposite directions to each other so as to show the lower ejection opening 44. FIG. 4A is a sectional view of the toner storing container 18 taken along line IV-IV in FIG. 3A in a state where the lower ejection opening 44 is closed. FIG. 4B is a sectional view of the toner storing container 18 taken along line IV-IV in FIG. 3A in a state where the lower ejection opening 44 is opened. FIG. 5 is an exploded perspective view showing the developer storing container 18 as seen in the same direction as the FIG. 3A.

As shown in FIGS. 4A through 5, the developer storing container 18 has an outer case 40, an inner case 50, a side case 60 and an agitation member 70. These components of the developer storing container 18 will be herein described.

Figure 6A:
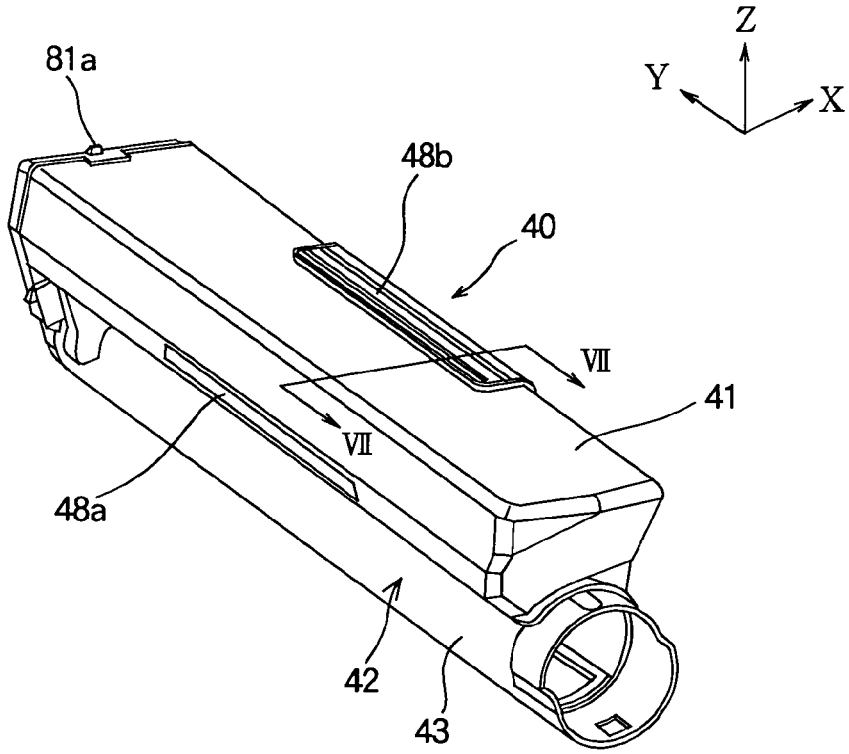
FIGS. 6A and 6B are perspective views showing an outer case of the developer storing container according to Embodiment 1 as seen in opposite directions to each other.
Figure 6B:
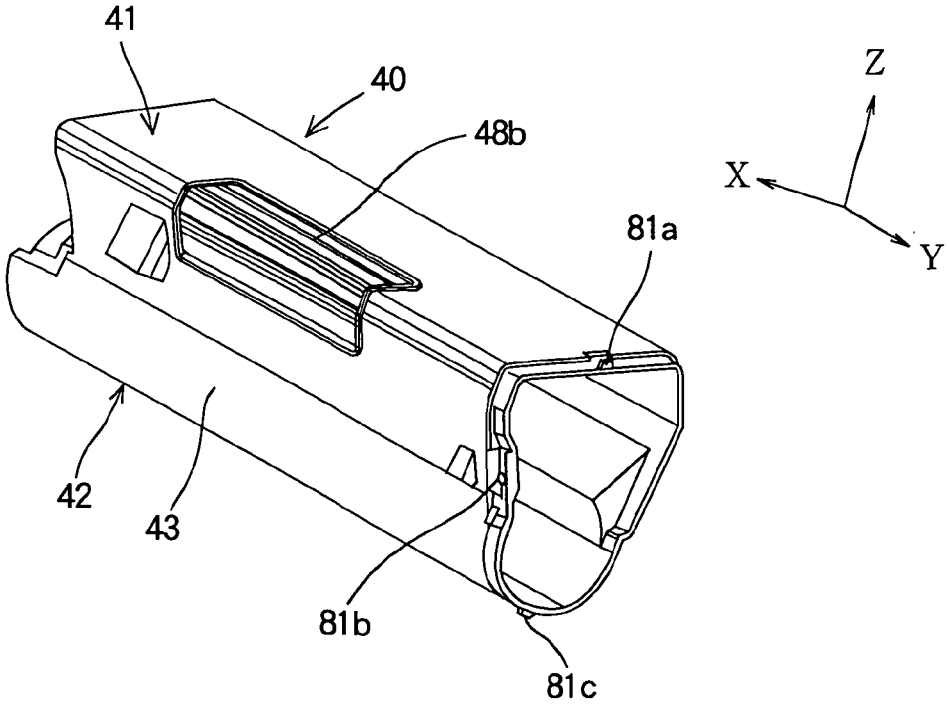
Figure 7:
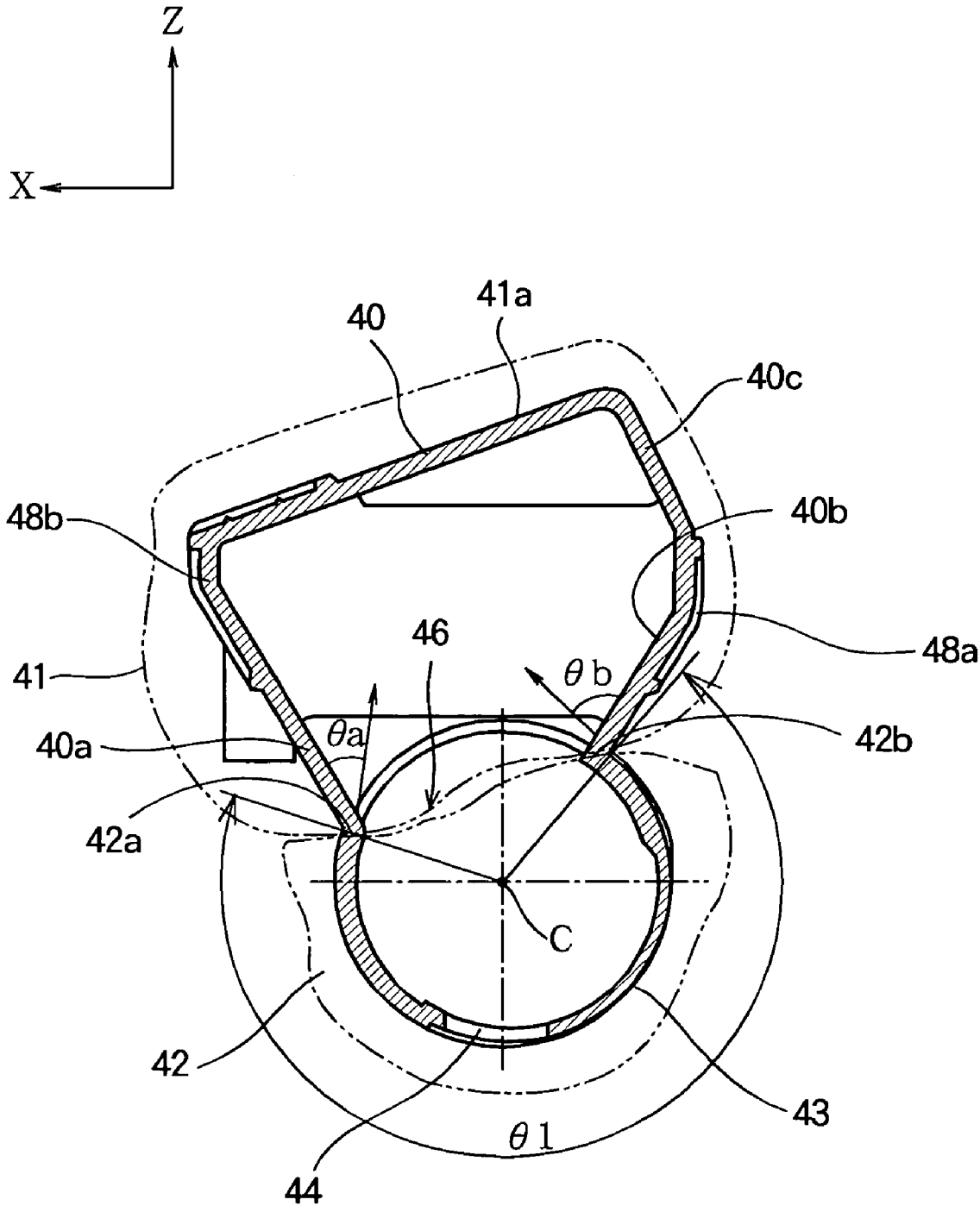
FIG. 7 is a sectional view of the outer case showing the developer storing container according to Embodiment 1 taken along line VII-VII in FIG. 6A.

FIGS. 6A and 6B are top perspective views of an outer case 40 as seen in opposite directions to each other. FIG. 7 is a sectional view taken along line VII-VII in FIG. 6A.

The outer case 40 includes a polygonal portion 41 (i.e., a first hollow portion, a second developer storing portion) and an arc-shaped portion 42 (i.e., a second hollow portion, a first developer storing portion). To facilitate understanding, the polygonal portion 41 and the arc-shaped portion 42 are enclosed by dashed lines in FIG. 7. The arc-shaped portion 42 has a surrounding wall 43 having a cross-section of a circular arc whose center axis C is defined in the Y-direction and whose center angle θ1 is larger than 180 degrees (in this example, 248 degrees). The surrounding wall 43 has both ends 42*a* and 42*b* respectively connected to connecting portions 40*a* and 40*b* (i.e., first and second outer walls) of the polygonal portion 41. The connecting portions 40*a* and 40*b* are in the form of flat plates. A wall 40*c* (i.e., a third outer wall) is formed between the connecting portions 40*a* and 40*b*. The connecting portions 40*a* and 40*b* and the wall 40*c* form a surrounding wall 41*a* (i.e., a second surrounding wall) of the polygonal portion 41. The connecting portions 40*a* and 40*b* extend from the ends 42*a* and 42*b* of the surrounding wall 43 in a widening manner. In other words, the connecting portions 40*a* and 40*b* of the polygonal portion 41 are connected to the ends 42*a* and 42*b* of the surrounding wall 43 at predetermined angles θa and θb (θa, θb>0). Therefore, a connection opening 46 defined by the ends 42*a* and 42*b* of the arc-shaped portion 42 (connected to the polygonal ortion 41) is elongated in the longitudinal direction of the arc-shaped cross-section portion 42 and has a width defined by the center angle θ1.

In this regard, the above described center angle θ is defined as an angle between a line connecting the end 42*a* of the surrounding wall 43 and the center axis C and another line connecting the end 42*b* of the surrounding wall 43 and the center axis C in cross-section (i.e., XZ-section).

The lower ejecting opening 44 is formed on the surrounding wall 43 of the arc-shaped portion 42 for ejecting the toner. The polygonal portion 41 has grip portions 48*a* and 48*b* that face each other on both sides of the polygonal portion 41 in the X-direction (i.e., the widthwise direction). These grip portions 48*a* and 48*b* have ribs or recesses extending in the longitudinal direction (i.e., the Y-direction) so that a user can easily grip the developer storing container 18.

Figure 8:
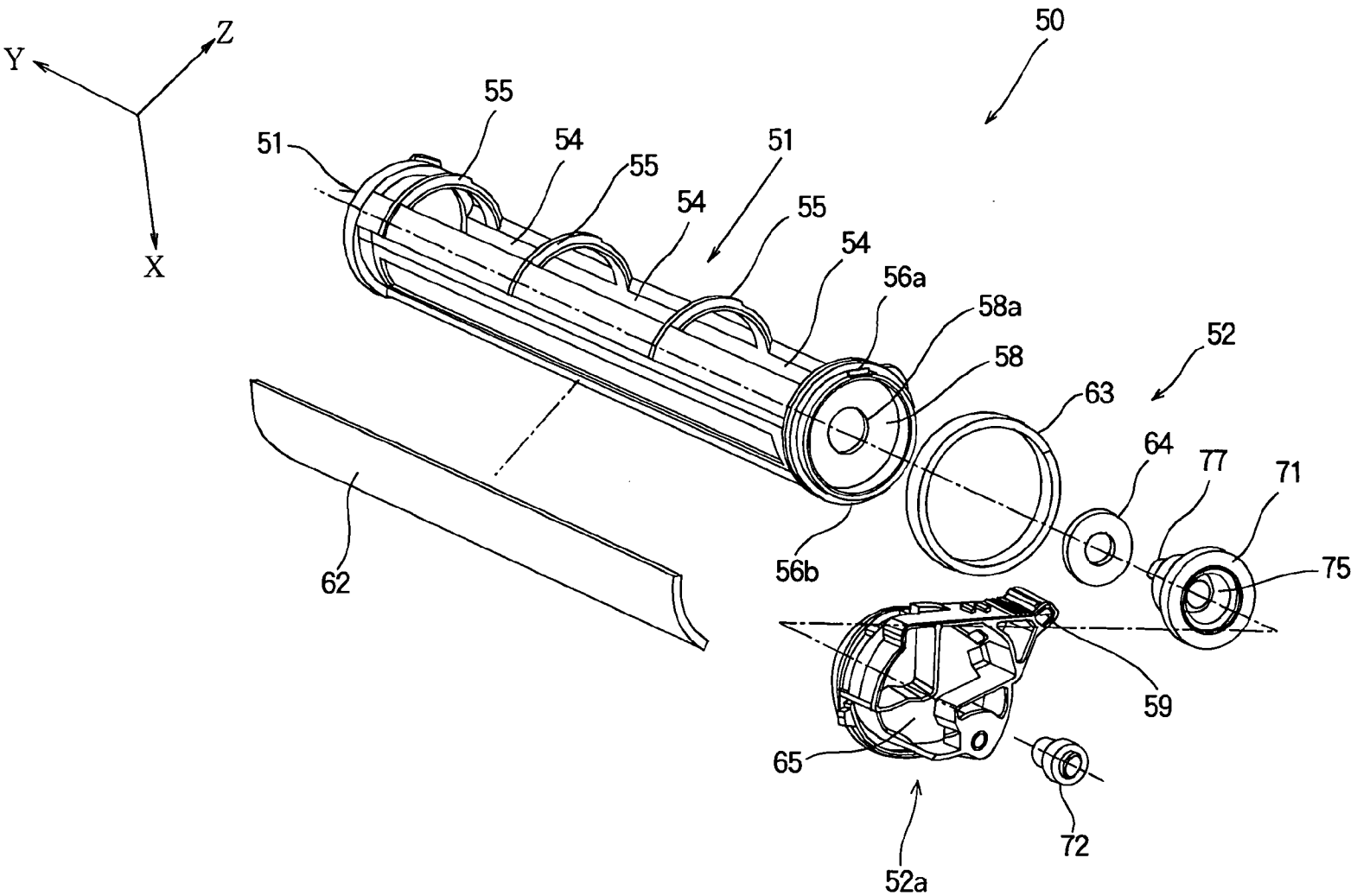
FIG. 8 is a top exploded perspective view showing an inner case of the developer storing container according to Embodiment 1.
Figure 9:
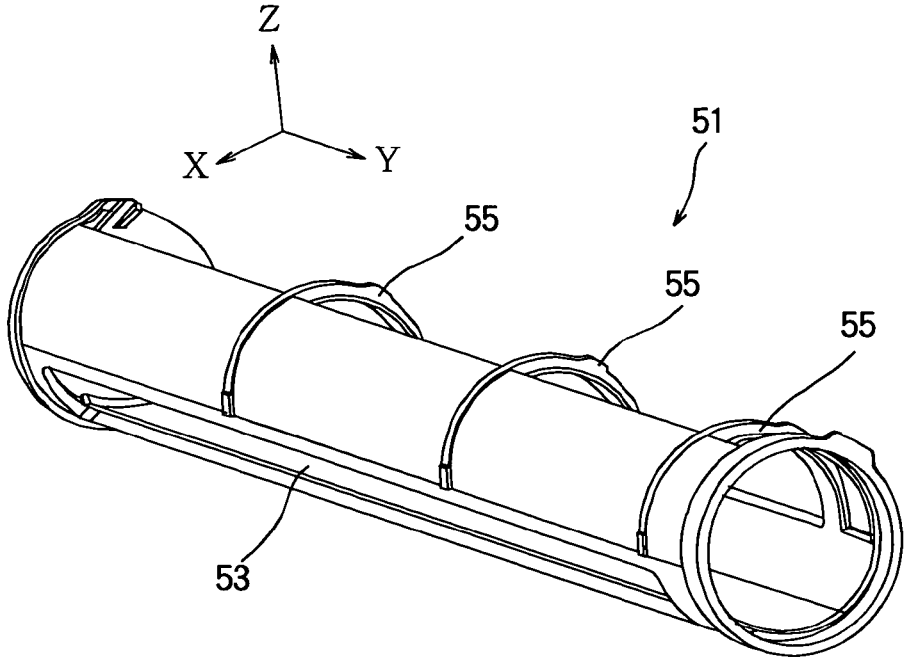
FIG. 9 is a perspective view showing a shutter portion of the inner case shown in FIG. 8 as seen in the different direction.
Figure 10:
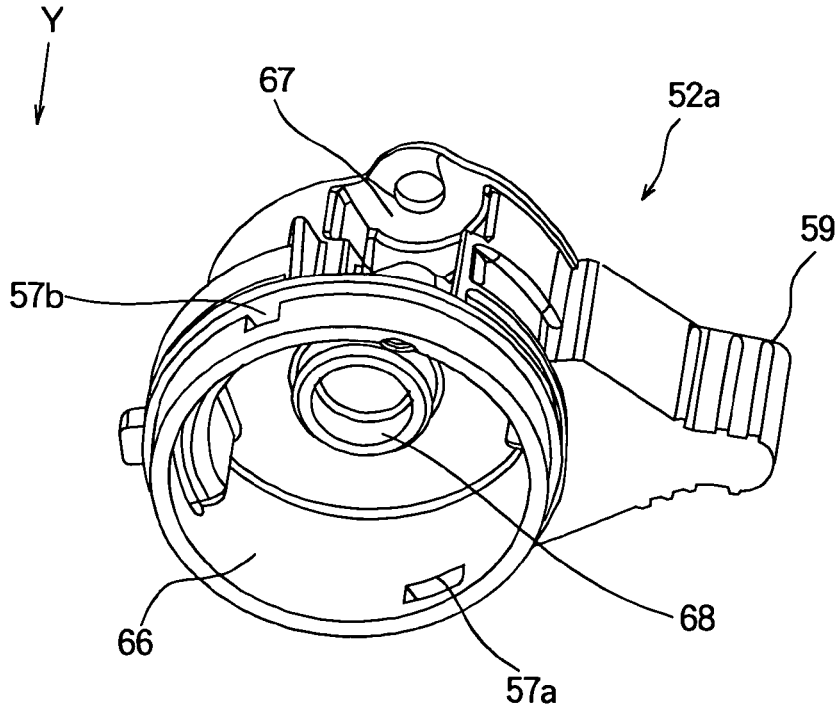
FIG. 10 is a perspective view showing a lever main body of a lever portion of the inner case shown in FIG. 8 as seen in the different direction so as to show an inside of the lever main body.

FIG. 8 is a top exploded perspective view showing an inner case 50. FIG. 9 is a perspective view showing a shutter portion 51 as seen in a direction different from FIG. 8. FIG. 10 is a perspective view showing a lever main body of a lever portion of the inner case 50 as seen in an opposite direction to FIG. 8 so that the inside of the lever main body can be seen. In this regard, in FIGS. 8, 9 and 10, XYZ coordinate indicates respective directions in a state where the inner case 50 is in a position to close the lower ejection opening 44 of the developer storing container 18.

As shown in FIG. 8, the inner case 50 includes a shutter portion 51 and a lever portion 52 coupled to an end of the shutter portion 51 in the longitudinal direction as described later. The shutter portion 51 rotates together with the lever portion 52. When the inner case 50 is mounted to the outer case 40, the shutter portion 51 is disposed in the outer case 40, and the lever portion 52 protrudes from the outer case 40, as shown in FIG. 3A.

The shutter portion 51 has a substantially cylindrical shape as shown in FIG. 8. The shutter portion 51 has an upper opening 54 through which the toner in the polygonal portion 41 is supplied via the upper opening 54 to the lower ejection opening 44 in a state where the developer storing container 18 is mounted to the developing unit main body 2*a* as shown in FIG. 2. Further, when the inner case 50 is in a position to open the lower ejection opening 44 of the developer storing container 18 as shown in FIG. 4B, the upper opening 54 faces the connection opening 46. The upper opening 54 has a size so as not to narrow the connection opening 46.

At lease one shape-maintaining rib 55 is provided in the upper opening 54, which maintains a cylindrical shape of the shutter portion 51 around the upper opening 54. Engaging ribs 56*a* and 56*b* are formed on an end of the shutter portion 51 in the longitudinal direction, which engage engaging holes 57*a* and 57*b* (FIG. 10) formed on the lever main body 52*a*. The engaging ribs 56*a* and 56*b* of the shutter portion 51 have widths different from each other. The engaging holes 57*a* and 57*b* of the lever main body 52*a* have widths corresponding to the widths of the engaging ribs 56*a* and 56*b*. With such a configuration, the shutter portion 51 and the lever main body 52*a* do not engage each other at incorrect rotational position. A side wall 58 is formed on an end of the shutter portion 51 in the longitudinal direction on the same side as the engaging ribs 56*a* and 56*b*. The side wall 58 has an agitation member insertion shaft receiving hole 58*a* for receiving an agitation member insertion shaft 77 (FIG. 12) of the agitation driving member 71 as described later.

As shown in FIG. 8, a seal member 62 composed of urethane sponge or the like is disposed on a predetermined position on the outer circumferential surface of the inner case 50. In the case where the inner case 50 is in a rotational position to close the lower ejection opening 44 of the developer storing container 18 as shown in FIG. 4A, the seal member 62 faces the lower ejection opening 44 of the outer case 50, and contacts the inner surface of the outer case 50 so as to close the lower ejection opening 44. With this, the seal member 62 seals the outer case 50 and prevents the toner from leaking through the lower ejection opening 44. For this purpose, the seal member 62 is disposed on an area sufficient for entirely sealing the lower ejection opening 44.

As shown in FIG. 4B, in the case where the inner case 50 is in a rotational position to open the lower ejection opening 44 of the developer storing container 18, a supplying opening 53 formed on the inner case 50 overlaps with the lower ejection opening 44 of the outer case 40, and opens the lower ejection opening 44. In this state, the upper opening 54 of the shutter portion 51 faces the connection opening 46 of the outer case 40, and therefore the toner in the polygonal portion 41 is smoothly led to the lower ejection opening 44.

As shown in FIGS. 8 and 10, the lever main body 52*a* of the lever portion 52 has a substantially cylindrical shape, and includes a knob 59 protruding from the cylindrical part. The knob 59 is operated by a user to rotate the lever main body 52*a*. The lever main body 52*a* has an engaging groove 65 that engages a not shown engaging rib of the developing unit main body 2*a* when the developer storing container 18 is set in the developing unit main body 2*a* (FIG. 2). The lever main body 52*a* further includes an agitation driving member mounting portion 66 for mounting the agitation driving member 71, and an agitation force transmitting member mounting portion 67 for mounting an agitation force transmitting member 72. The knob 59 has ribs or recesses extending in the axial direction of the lever main body 52*a*. The agitation driving member mounting portion 66 has a post 68 for allowing the agitation driving member 71 to rotate. The post 68, the agitation driving member receiving hole 58*a* and the agitation driving member 71 are aligned with each other in a state where the shutter portion 51 and the lever main body 52*a* are coupled to each other.

Figure 11:
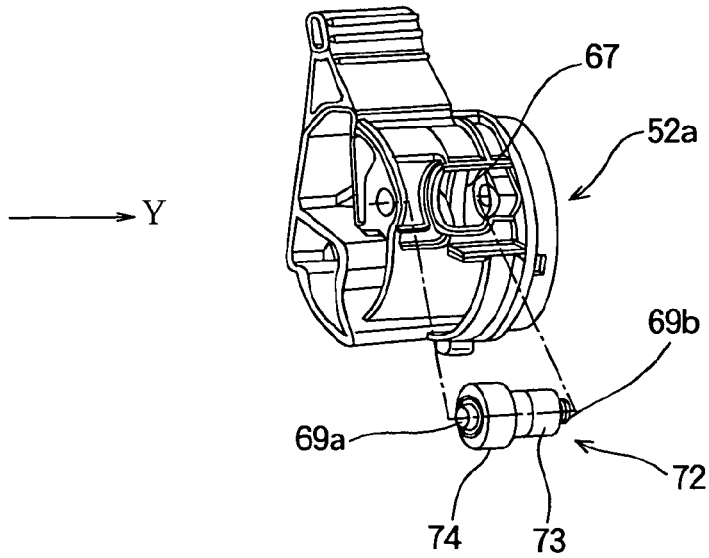
FIG. 11 is a perspective view showing an agitation force transmitting member and an agitation force transmitting member mounting portion of the lever main body according to Embodiment 1.

FIG. 11 is a perspective view showing the agitation force transmitting member mounting portion 67 of the lever main body 52*a* and the agitation force transmitting member 72 mounted therein.

As shown in FIG. 11, the agitation force transmitting member 72 includes shafts 69*a* and 69*b*, a driving force receiving portion 74 that receives a force from the developing unit main body 2*a* and a transmitting portion 73 for transmitting the force to the agitation driving member 71. The shafts 69*a* and 69*b*, the driving force receiving portion 74 and the transmitting portion 73 are aligned with each other. The shafts 69*a* and 69*b* are inserted into shaft receiving holes formed on the agitation force transmitting member mounting portion 67 of the lever main body 52*a* so that the agitation force transmitting member 72 is rotatable. After the developer storing container 18 is set in the developing unit main body 2*a*, the lever 52 is operated to rotate the inner case 50 from a rotational position (as shown in FIG. 4A) to close the lower ejection opening 44 of the developer storing container 18 to a rotational position (as shown in FIG. 4B) to open the lower ejection opening 44 of the developer storing container 18. With this, the driving force receiving portion 74 engages a not shown transmitting portion of the developer unit main body 2*a*, and receives a rotational force from the developing unit main body 2*a*.

Figure 12A:
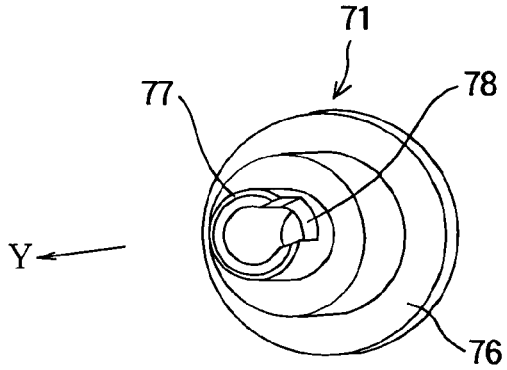
FIGS. 12A and 12B are perspective views showing an agitation driving member according to Embodiment 1 as seen in opposite directions to each other.
Figure 12B:
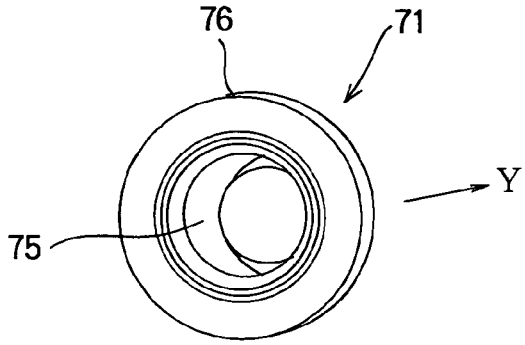
Figure 13:
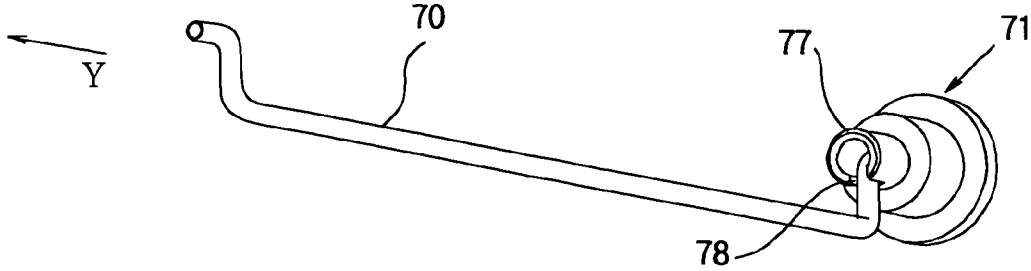
FIG. 13 is a perspective view showing a crank-shaped agitation member according to Embodiment 1 whose one end engages an agitation driving member.

FIGS. 12A and 12B are perspective views showing the agitation driving member 71 as seen in opposite directions to each other.

As shown in FIGS. 12A and 12B, the agitation driving member 71 has the agitation member insertion shaft 77 that engages the agitation member 70 (FIG. 5) and a shaft receiving portion 75 that receives the post 68 (FIG. 10). The agitation member insertion shaft 77 is disposed on an end of the agitation driving member 71 and the shaft receiving portion 75 is disposed on the other end of the agitation driving member 71. Further, an agitation force receiving portion 76 is formed on the outer circumference of the agitation driving member 71, which engages the agitation force transmitting member 72 to receive a driving force. The agitation member insertion shaft 77 is inserted into the agitation member insertion shaft receiving hole 58*a* (FIG. 8). An agitation member insertion groove 78 is formed on the agitation member insertion shaft 77. An end of the crank-shaped agitation member 70 engages the agitation member insertion groove 78, so that the agitation member 70 is able to rotate according to the rotation of the agitation driving member 71.

Figure 14:
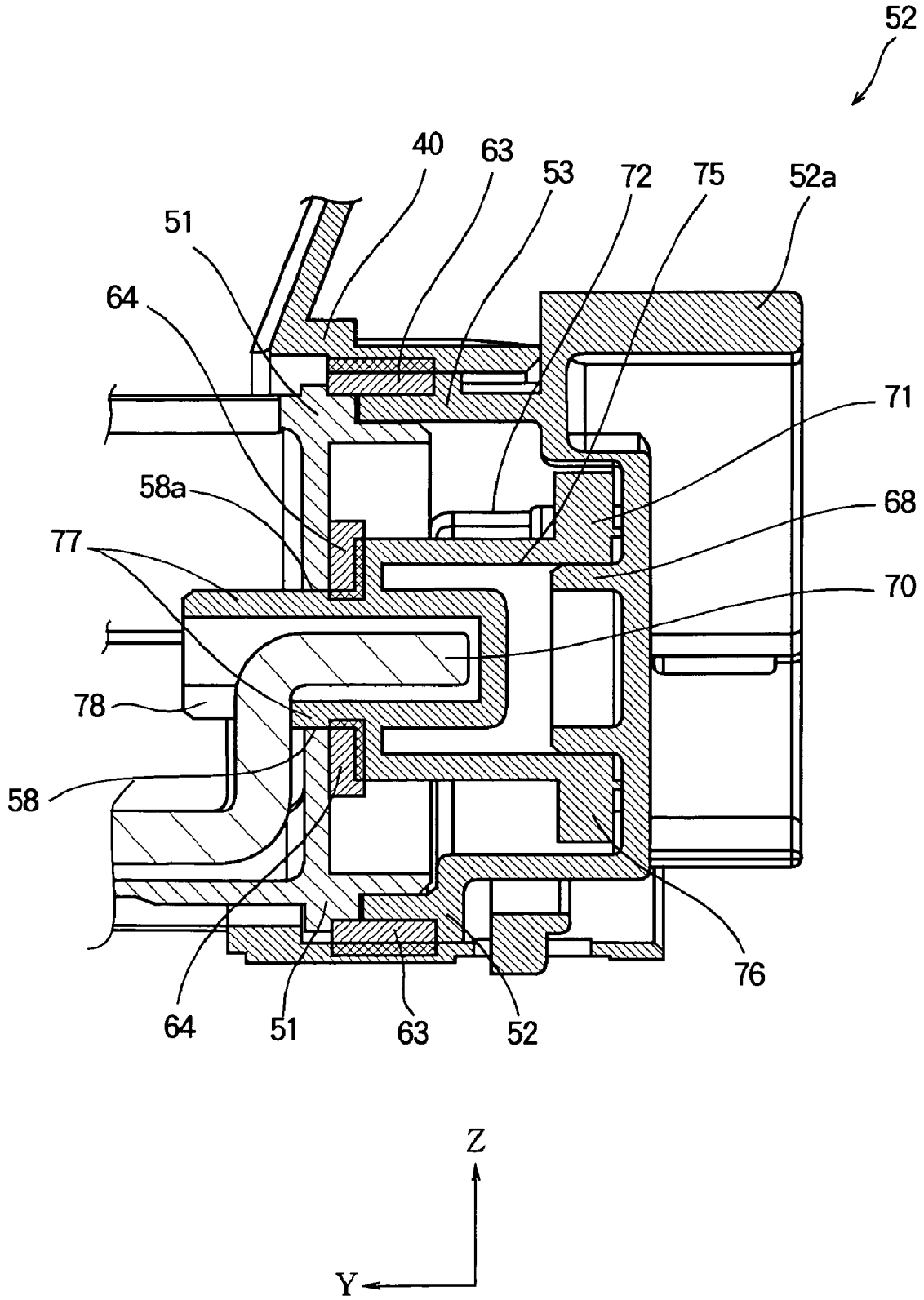
FIG. 14 is a partially sectional view showing positional relationship between the lever main body, the agitation driving member, the agitation force transmitting member and a seal member according to Embodiment 1.

FIG. 14 is a partially sectional view showing positional relationship between the lever main body 52*a*, the agitation driving member 71, the agitation force transmitting member 72 and seal members 63 and 64.

As shown in FIG. 14, the agitation member insertion shaft 77 of the agitation driving member 71 is inserted into the agitation member insertion shaft receiving hole 58*a* of the shutter portion 51. The seal member 64 is disposed between the shutter portion 51 (to be more specific, the side wall 58) and the agitation driving member 71. The seal member 64 prevents leakage of the toner through between the agitation member insertion shaft receiving hole 58*a* and the outer surface of the agitation member insertion shaft 77.

The lever main body 52*a* (to which the agitation force transmission member 72 is mounted) is coupled to the shutter portion 51 at a rotational position where the engaging ribs 56*a* and 56*b* of the lever main body 52*a* respectively engage the engaging holes 57*a* and 57*b* (FIG. 10) in a state where the post 68 engages the shaft receiving portion 75 of the agitation driving member 71. With this, the agitation driving member 71 is rotatably supported by the shutter portion 51 and the lever main body 52*a*. Further, the agitation driving member 71 receives the rotational driving force from the developing unit main body 2*a* due to the engagement between the agitating force receiving portion 76 and the transmitting portion 73 of the agitation force transmitting member 72 (FIG. 11), and rotates so as to cause the agitation member 70 to rotate. The seal member 63 is disposed between the outer case 40, the shutter portion 51 and the lever main body 52*a*. The seal member 63 prevents the leakage through between the shutter portion 51 and the lever main body 52*a* and through between the lever main body 52*a* and the inner surface of the outer case 40.

Figure 15B:
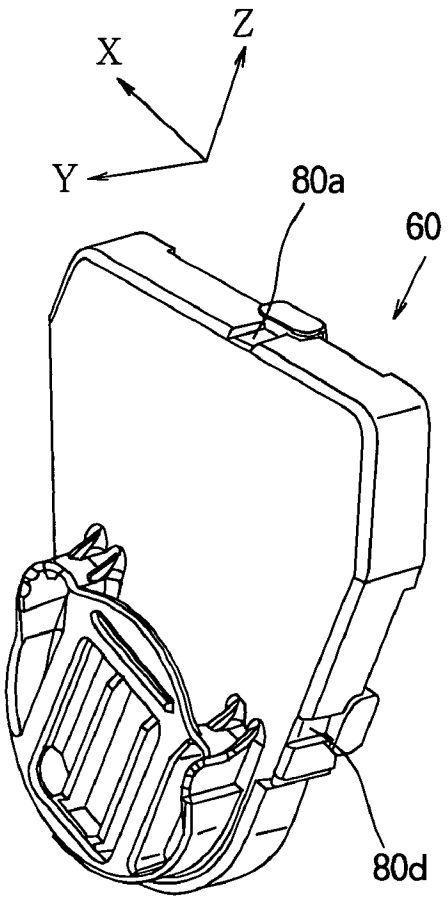
FIGS. 15A and 15B are perspective views showing a side-case of the developer storing container according to Embodiment 1 as seen in opposite directions to each other.
Figure 15A:
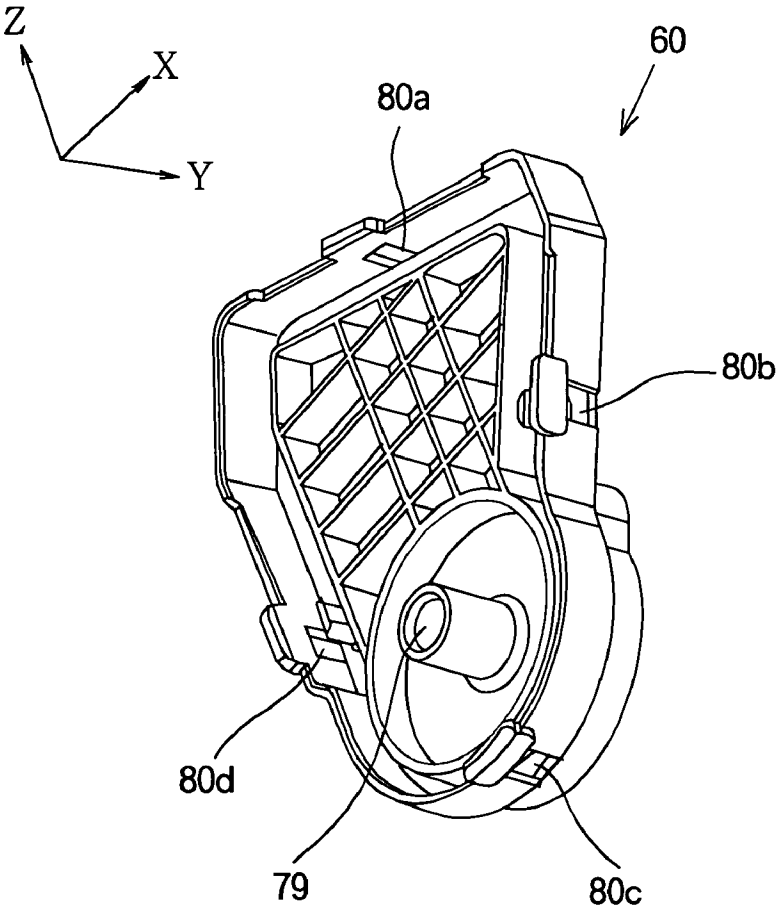

FIGS. 15A and 15B are perspective views showing shape of a side case 60 as seen in opposite directions to each other.

As shown in FIGS. 15A and 15B, latch holes 80*a*, 80*b*, 80*c* and 80*d* are formed on an outer frame of the side case 60. An agitation member shaft receiving portion 79 is formed on an inner side of the side case 60 facing the outer case 40. The agitation member shaft receiving portion 79 rotatably supports the end of the crank-shaped agitating member 70 (i.e., opposite to the end supported by the agitation driving member 71). When the side case 60 is mounted to the outer case 40, the agitation member shaft receiving portion 79 is disposed coaxially with the rotation shaft of the agitation member 71, and the end of the agitation member 70 engages the agitation member shaft receiving portion 79 in such a manner that the latch holes 80*a*, 80*b*, 80*c* and 80*d* engage latch ribs 81*a*, 81*b*, 81*c* and 81*d* of the outer case 40. As shown in FIGS. 6A and 6B, the latch ribs 81*a*, 81*b*, 81*c* and 81*d* are formed on an end portion of the outer case 40 in the longitudinal direction opposite to the end portion to which the lever portion 52 is mounted.

A seal member 61 (FIG. 5) is disposed between the outer case 40 and the side case 60 for preventing leakage of the toner through between the outer case 40 and the side case 60. The seal member 61 is preliminarily mounted to the side case 60 as shown in FIG. 5.

In the above described developer storing container 18, the inner case 50 and the side case 60 are mounted to the outer case 40 as shown in FIG. 5. Both ends of the agitation member 70 are held by the agitation driving member 71 of the lever portion 52 and the agitation member shaft receiving portion 79 of the side case 60. The agitation member 70 receives the rotational driving force from the developing unit main body 2*a* to rotate. The inner case 50 is rotated by the operation by the user so as to open and close the lower ejection opening 44.

Figure 16:
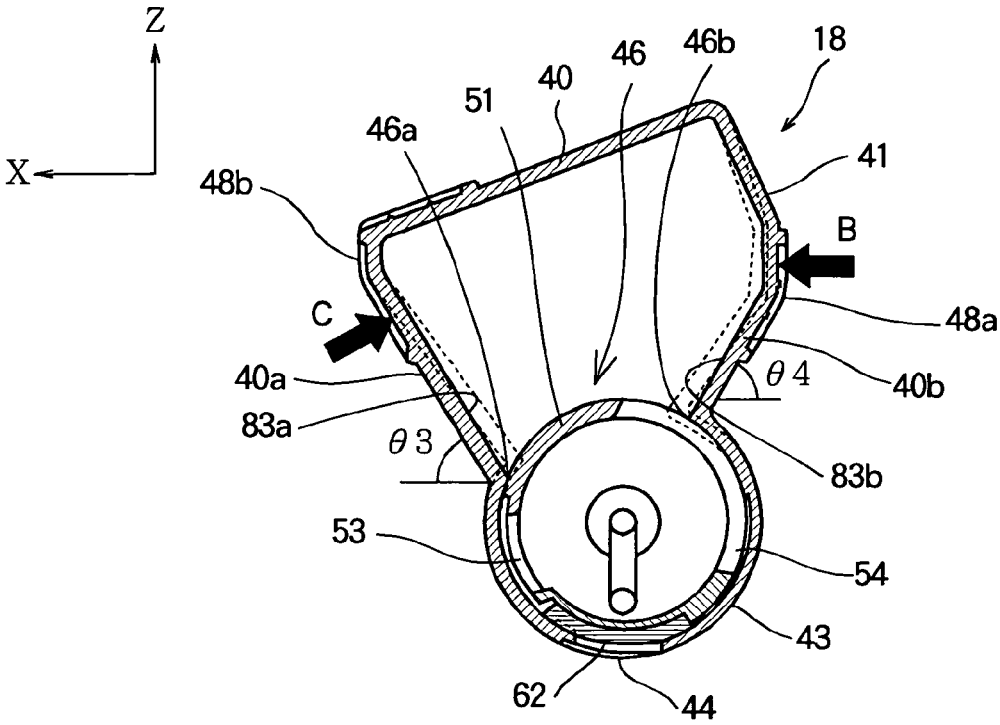
FIG. 16 is a schematic sectional view for illustrating a deformation of the developer storing container when a user strongly holds the developer storing container while setting the developer storing container in a developing unit main body according to Embodiment 1.

Next, description will be made to a condition of the developer storing container 18 when a load is applied to the developer storing container 18 with reference to FIGS. 16 and 17. FIG. 16 is a schematic view for illustrating deformation of the developer storing container 18 when a user strongly grips the developer storing container 18 during the setting of the developer storing container 18 into the developer storing unit main body 2*a* (FIG. 2).

As shown in FIG. 16, when the user grips the developer storing container 18 at the grip portions 48*a* and 48*b*, pressing forces are applied to the grip portions 48*a* and 48*b* in directions substantially perpendicular to surfaces of the grip portions 48*a* and 48*b* as shown by arrows B and C. With such pressing forces, the grip portions 48*a* and 48*b* deform inwardly, and inner surfaces 83*a* and 83*b* of the connecting portions 40*a* and 40*b* of the polygonal portion 41 deform inwardly as shown by dashed lines in FIG. 16. In this regard, the inner surfaces 83*a* and 83*b* are inclined with respect to the horizontal surface at inclination angles θ3 and θ4 each of which is greater than equal to 50 degrees, so that the toner freely falls down without being stuck on the inner surfaces 83*a* and 83*b* in a state where the developer storing container 18 is mounted to the developing unit main body 2*a*. As illustrated in FIGS. 4 and 16, the second surrounding wall 41*a* includes first and second outer walls 40*a* and 40*b*, each having the grip portions 48*a* and 48*b* disposed thereupon, a maximum distance between said first and second outer walls 40*a* and 40*b* being larger than a maximum outer diameter of the arc-shaped portion 42 (i.e., first hollow portion, first developer storing portion). Said grip portions 48*a* and 48*b* are provided at portions of said first and second outer walls 40*a* and 40*b* having said maximum distance therebetween. The first grip portion 48*a* is disposed a different distance from the arc-shaped portion 42 than the second grip portion 48*b*. Further, the first and second grip portions 48*a* and 48*b* have different shapes and are curved inwardly towards an interior of the developer storing container 18.

When the inclined surfaces 83*a* and 83*b* deform inwardly as shown by dashed lines, an interval between the inclined surfaces 83*a* and 83*b* (i.e., the connection opening 46) becomes narrow. Therefore, the shutter portion 51 is pressed from both sides mainly by both edge portions 46*a* and 46*b* of the connection opening 46 substantially in the horizontal direction. With this, the toner storing container 18 is pressed downwardly. To be more specific, the shape-maintaining ribs 55 (FIG. 8) formed on the upper opening 54 of the shutter portion 51 are pressed strongly by the edge portions 46*a* and 46*b* downwardly, which contributes to enhancement of sealing of the lower ejection opening 44.

That is, in this embodiment, the outer case 40 is so configured that the center angle θ1 of the arc-shaped portion 42 is greater than or equal to 180 degrees. With this, when the user grips the grip portions 48*a* and 48*b* of the developer storing container 18, the edge portions 46*a* and 46*b* of the connection opening 46 press an upper half part of the shutter portion 51 (of substantially cylindrical shape) from both sides substantially in horizontal direction, and a force that presses the shutter portion 51 downward is generated. With this force, the seal member 62 disposed on the shutter portion 51 is strongly pressed against the lower ejection opening 44 of the outer case 40, and therefore sealing of the lower ejection opening 44 is enhanced.

Figure 17A:
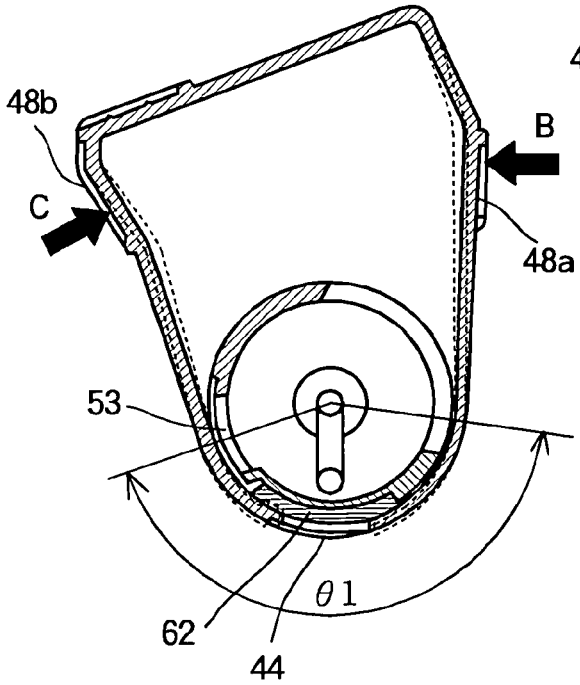
FIG. 17A is a schematic view for illustrating a comparative example with respect to the developer storing container of Embodiment 1.
Figure 17B:
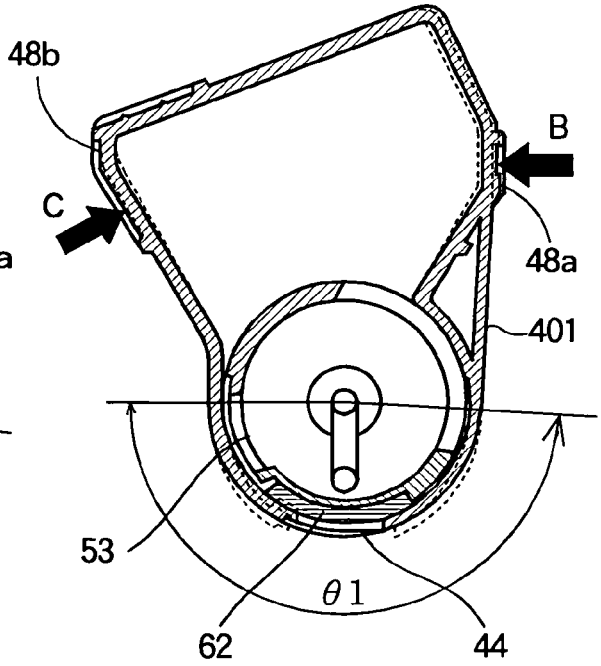
FIG. 17B is a schematic view for illustrating another comparative example with respect to the developer storing container of Embodiment 1.

FIGS. 17A and 17B show configurations of developer storing containers according to comparative examples with respect to Embodiment 1.

In a first comparative example shown in FIG. 17A, the outer case 40 is so configured that the center angle θ1 of the arc-shaped portion 42 is less than 180 degrees. In a second comparative example shown in FIG. 17B, the outer case 40 is so configured that the center angle θ1 of the arc-shaped portion 42 is greater than 180 degrees, but the outer case 40 has another exterior wall 401 that makes the arc-shaped portion of the outer case 40 have a center angle θ1 less than or equal to 180 degrees.

In the comparative examples shown in FIGS. 17A and 17B, the lower ejection opening 44 is widened as the grip portions 48*a* and 48*b* deform inwardly. Therefore, a gap may be formed between the lower ejection opening 44 and the seal member 62 and the toner may leak outside therethrough. In such cases, it is necessary to strongly push the seal member 62 against the inner surface of the ejection opening 44 for preventing the leakage of the toner, which increases a load for rotating the inner case 50 (i.e., a load for operating the knob 59).

In this regard, although the outer case is explained as an integrally-formed member in this embodiment, it is also possible that the arc-shaped portion and the polygonal portion are formed as separate members and coupled to each other. Further, although the shutter portion and the lever portion of the inner case are formed as separate members in this embodiment, it is also possible that the shutter portion and the lever portion of the inner case are integrally formed. Furthermore, although the side case is mounted to the outer case by means of the latches in this embodiment, it is also possible that the side case can be fixed to the outer case by means of welding or bonding. In this case, it is not necessary to provide a seal member between the side case and the outer case. Moreover, although the agitation member is provided in this embodiment, it is also possible not to use the agitation member. In this case, members or structures for driving the agitation member can be eliminated.

In the developer storing container 18, there is a possibility that the polygonal portion 41 may be applied with an external force, for example, when the outer case 40 of the polygonal portion 41 is strongly gripped or hit. In such a case, according to Embodiment 1, the seal member 62 (disposed on the shutter portion 51 of the inner case 50) is strongly pressed against the lower ejection opening 44 of the outer case 40. Therefore, sealing of the lower ejection portion 44 (particularly, when the developer storing container 18 is held outside the image forming apparatus 1) is enhanced, and it becomes possible to prevent the toner from leaking outside. In other words, it is not necessary to strongly press the seal member 62 against the inner surface of the arc-shaped portion 42 around the lower ejection opening 44 in order to prevent leakage of the developer. As a result, load for rotating the inner case 50 is reduced, and it becomes easy for a user to rotate the inner case 50. Further, when the user operates the knob 59, the seal member 62 has returned to its original state, and therefore the load for operating the knob 59 can be reduced.

Embodiment 2

Figure 18:
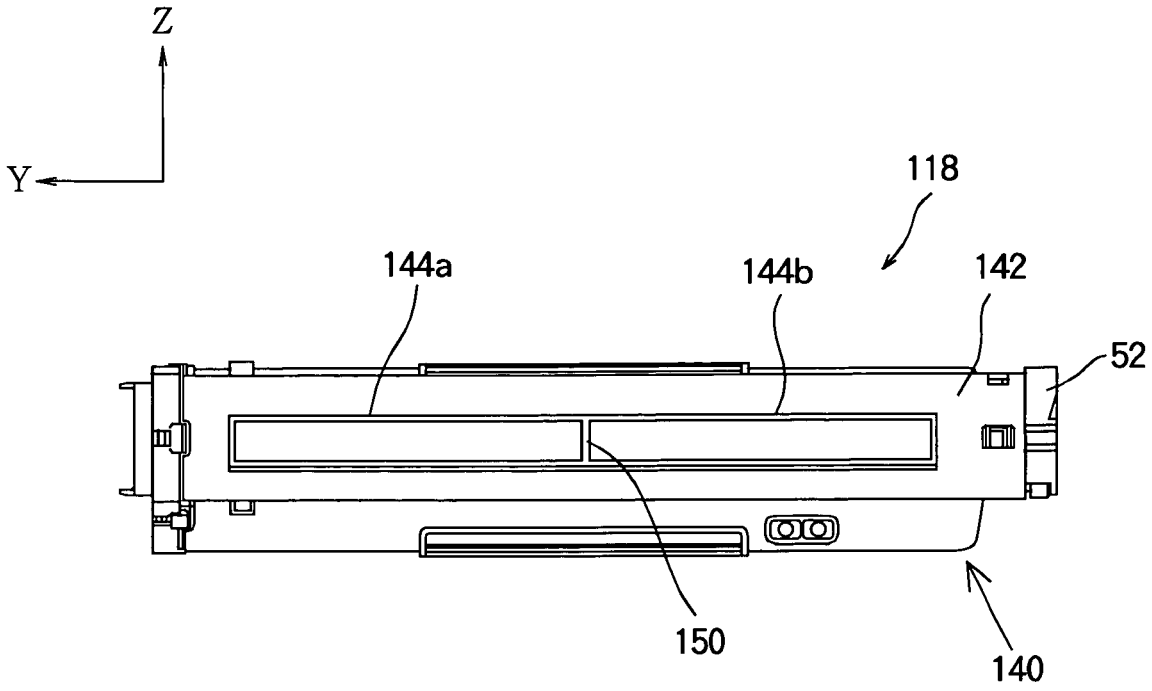
FIG. 18 is a bottom view showing a developer storing container according to Embodiment 2 of the present invention for illustrating a lower ejection opening thereof.

FIG. 18 is a bottom view of a developer storing container 118 for illustrating a lower ejection opening thereof according to Embodiment 2 of the present invention.

As shown in FIG. 18, an outer case 140 of the developer storing container 118 of Embodiment 2 includes an arc-shaped portion 142 having two lower ejection openings 144*a* and 144*b* formed on the bottom of the arc-shaped portion 142. Other parts of the developer storing container 118 are the same as those of the developer storing container 18 of Embodiment 1. Components of the image forming apparatus according to Embodiment 2 which are the same as those of the image forming apparatus 1 (FIG. 1) according to Embodiment 1 are assigned the same reference numerals or omitted in figures. Descriptions will be focused on differences between the Embodiments 1 and 2.

The lower ejection openings 144*a* and 144*b* are so configured that a connection rib 150 is added to a center portion of the lower ejection opening 44 (FIG. 5) of the outer case 40 of Embodiment 1. The connection rib 150 divides the lower ejection openings 144*a* and 144*b* so that lower ejection openings 144*a* and 144*b* are adjacent to each other. Each of the lower ejection openings 144*a* and 144*b* has a length in the longitudinal direction which is less than or equal to ½ of an entire length of the developer storing container 118 in the longitudinal direction.

In the developer storing container 118, when the user strongly grips the developer storing container 118 at the grip portions 48*a* and 48*b* (see FIG. 16), the lower ejection openings 144*a* and 144*b* are strongly pressed from the inside by the seal member 62 disposed on the inner case 50. In this state, the lengths of the lower ejection openings 144*a* and 144*b* are short because of the connection rib 150, and therefore outward deformations of the lower ejection openings 144*a* and 144*b* are restricted. In this regard, the developer storing container 18 according to Embodiment 1 has the lower ejection opening 44 having a longer length, and therefore the lower ejection opening 44 relatively easily deform outwardly compared with the lower ejection openings 144*a* and 144*b* according to Embodiment 2.

Figure 19:
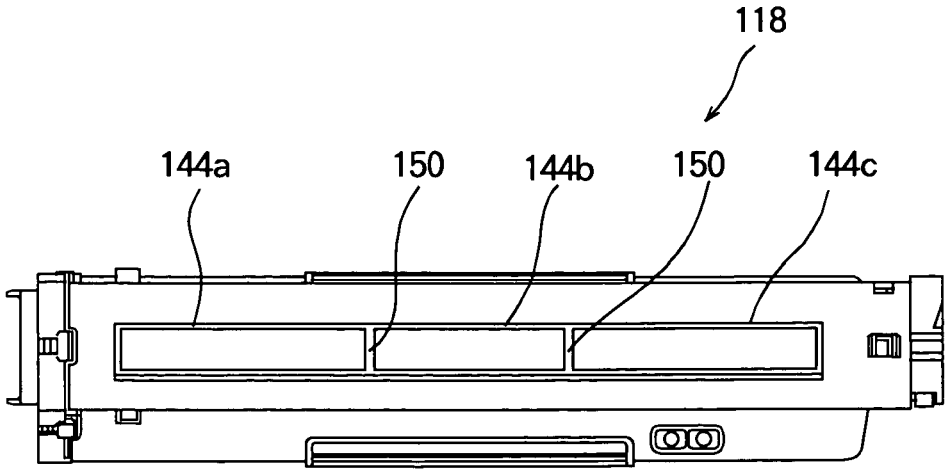
FIG. 19 shows a modification of the developer storing container according to Embodiment 2 of the present invention.
Figure 20:
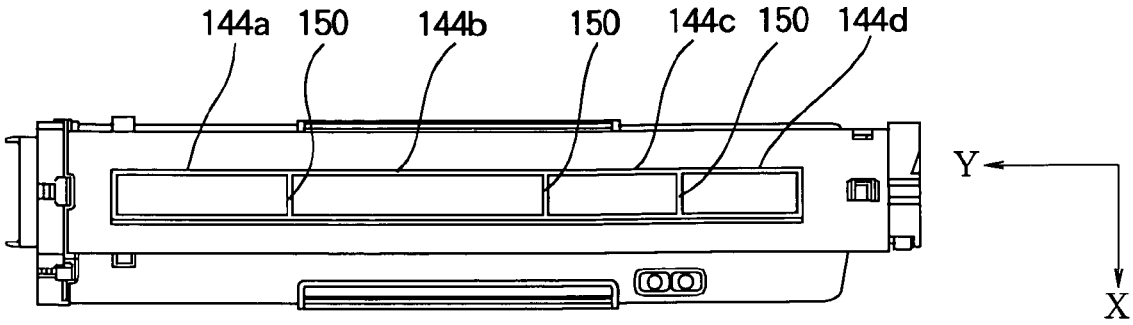
FIG. 20 shows another modification of the developer storing container according to Embodiment 2 of the present invention.
Figure 21:
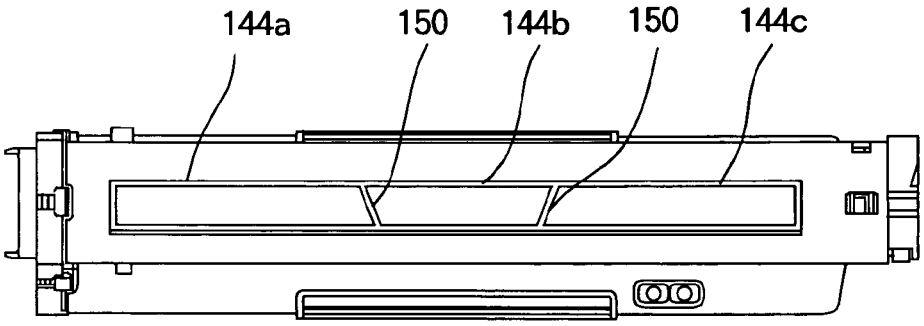
FIG. 21 shows still another modification of the developer storing container according to Embodiment 2 of the present invention.

FIGS. 19 through 21 show modifications of the developer storing container according to Embodiment 2.

The developer storing container of a modification shown in FIG. 19 has a configuration in which two connection ribs 150 are added to the lower ejection opening 44 (FIG. 5) of the outer case 40 of Embodiment 1. The connection ribs 150 divide the lower ejection opening into three lower ejection openings 144*a*, 144*b* and 144*c*. Each of the lower ejection openings 144*a*, 144*b* and 144*c* has a length in the longitudinal direction which is less than or equal to ½ of an entire length of the developer storing container 118 in the longitudinal direction.

The developer storing container of a modification shown in FIG. 20 has a configuration in which three connection ribs 150 are added to the lower ejection opening 44 (FIG. 5) of the outer case 40 of Embodiment 1. The connection ribs 150 unevenly divide the lower ejection opening into four lower ejection openings 144*a*, 144*b*, 144*c* and 144*d*. Each of the lower ejection openings 144*a*, 144*b*, 144*c* and 144*d* has a length in the longitudinal direction which is less than or equal to ½ of an entire length of the developer storing container 118 in the longitudinal direction.

The developer storing container of a modification shown in FIG. 21 has a configuration in which two inclined connection ribs 150 are added to the lower ejection opening 44 (FIG. 5) of the outer case 40 of Embodiment 1. The connection ribs 150 obliquely divide the lower ejection opening into three lower ejection openings 144*a*, 144*b* and 144*c*. Each of the lower ejection openings 144*a*, 144*b* and 144*c* has a length in the longitudinal direction which is less than or equal to ½ of an entire length of the developer storing container 118 in the longitudinal direction.

As described above, in this Embodiment 2, as long as the length of the lower ejection opening (in the longitudinal direction) is less than or equal to ½ of the entire length of the developer-storing container 118, the number of the lower ejection openings can be varied (FIG. 19), the lower ejection openings can have uneven lengths (FIG. 20), and the lower ejection openings can have oblique shapes (FIG. 21).

As described above, according to the developer storing container of Embodiment 2, the provision of the rib 150 contributes to enhancement in rigidity of the lower ejection openings 144*a* and 144*b*. Therefore, even when the lower ejection openings 144*a* and 144*b* are strongly pressed from the inside by the seal member 62, outward deformations of the lower ejection openings 144*a* and 144*b* are restricted. Therefore, decrease in sealing properties of the developer storing container 118 can be prevented.

Embodiment 3

Figure 22:
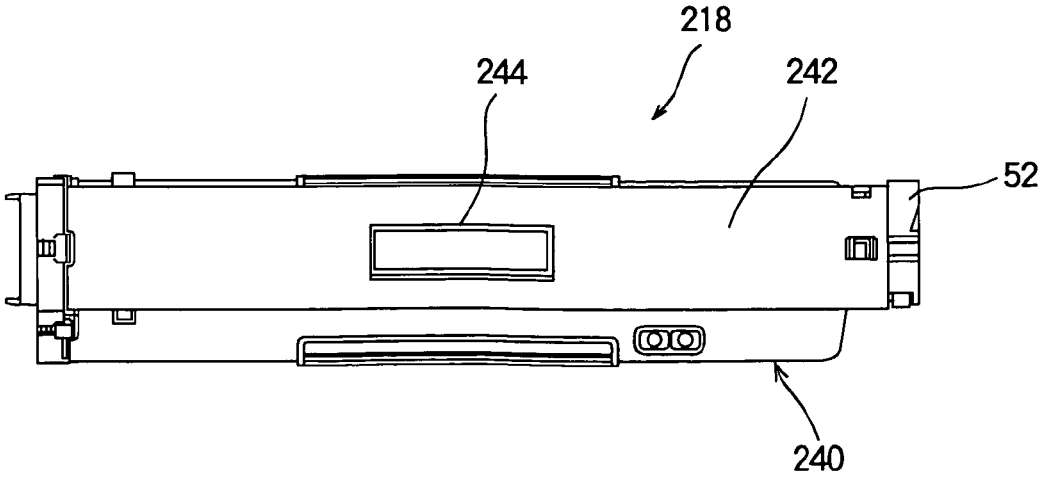
FIG. 22 is a bottom view showing a developer storing container according to Embodiment 3 of the present invention for illustrating a lower ejection opening thereof.

FIG. 22 is a bottom view showing a developer storing container for illustrating an ejection opening according to Embodiment 3 of the present invention.

The image forming apparatus using the developer storing container 218 according to Embodiment 3 is different from the image forming apparatus 1 according to Embodiment 1 in the following aspects. In Embodiment 3, the lower ejection opening 244 formed on the bottom of an arc-shaped portion 242 of an outer case 240 has a length in the longitudinal direction which is less than or equal to ½ of the entire length of the developer storing container 218 in the longitudinal direction. In accordance with this, a supplying opening (not shown) formed on the inner case 50 (see FIG. 9) of Embodiment 3 has a size which is substantially the same as the lower ejection opening 244, which is smaller than the supplying opening 53 (FIG. 9) of the inner case 50 of Embodiment 1. Further, a seal member (not shown) disposed on the inner case 50 of Embodiment 3 has a size sufficient for sealing the lower ejection opening 244, which is smaller than the seal member 62 (FIG. 8) of Embodiment 1. Other parts of the developer storing container 218 are the same as those of the developer storing container 18 of Embodiment 1. Components of the image forming apparatus according to Embodiment 3 which are the same as those of the image forming apparatus 1 (FIG. 1) according to Embodiment 1 are assigned the same reference numerals or omitted in figures. Descriptions will be focused on differences between the Embodiments 1 and 3.

In the developer storing container 218, when the user strongly grips the developer storing container 218 at the grip portions 48*a* and 48*b* (see FIG. 16), the lower ejection opening 244 is strongly pressed from the inside by the seal member (not shown) disposed on the inner case 50. In this state, the lower ejection opening 244 has the length (in the longitudinal direction) which is less than or equal to ½ of the entire length of the developer storing container 218 in the longitudinal direction, and therefore outward deformation of the lower ejection opening 244 is restricted. In this regard, the developer storing container 18 according to Embodiment 1 has the lower ejection opening 44 having a longer length, and therefore the lower ejection opening 44 relatively easily deform outwardly when pressed by the seal member 62 from the inside, compared with the lower ejection opening 244 according to Embodiment 3.

As described above, according to the developer storing container of Embodiment 3, the lower ejection opening 244 has the length (in the longitudinal direction) which is less than or equal to ½ of the entire length of the developer storing container 218 in the longitudinal direction, and therefore the rigidity of the lower ejection opening 244 is enhanced. Therefore, even when the lower ejection opening 244 is strongly pressed from the inside by the seal member 62, outward deformation of the lower ejection opening 244 is restricted. Therefore, decrease in sealing properties of the developer storing container 218 can be prevented. Moreover, the length of the seal member (in the longitudinal direction) disposed on the inner case can be reduced, and a rotational load of the inner case can be reduced. Therefore, a developer storing container which is easy to operate can be obtained.

Figure 23A:
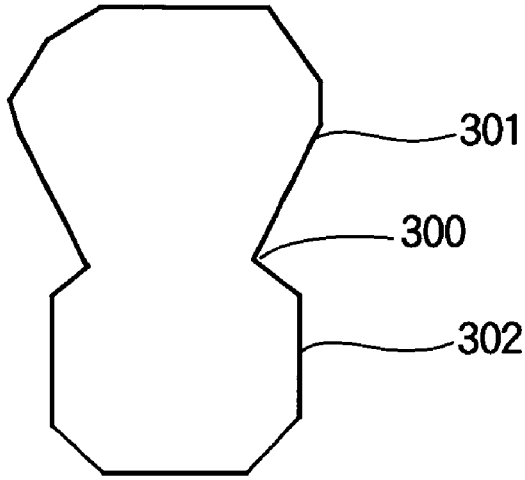
FIGS. 23A and 23B are schematic views showing further configuration examples of the outer case according to the present invention.
Figure 23B:
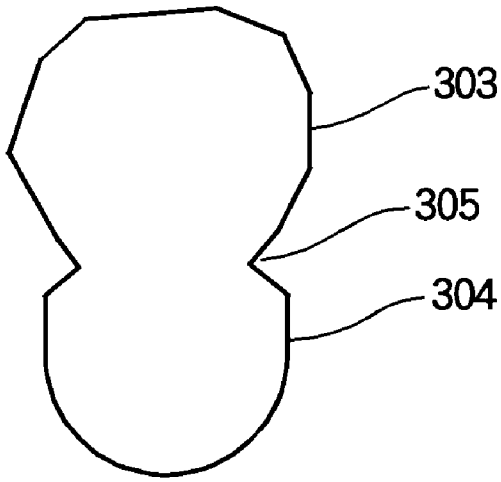

In the above described embodiments, the outer case 40 includes the arc-shaped portion 42 and the polygonal portion 41 as shown in FIG. 7. However, the present invention is not limited to such a configuration. For example, it is possible that a polygonal portion 301 has a substantially triangular cross-section and an arc-shaped portion 302 has a substantially polygonal cross-section as shown in FIG. 23A. A constricted portion 300 is formed between the polygonal portion 301 and the arc-shaped portion 302. Furthermore, it is also possible that a polygonal portion 303 has a substantially arc-shaped cross-section and an arc-shaped portion 304 has an elongated circular cross-section as shown in FIG. 23B. A constricted portion 305 is formed between the polygonal portion 303 and the arc-shaped portion 304. Further, various types modifications are employable.

The above described embodiments have been described using examples of image forming apparatus having a function of a printer. However, the present invention is not limited to this, but is applicable to a facsimile machine, a copier, an MFP (Multifunction Peripherals) or the like.

While the preferred embodiments of the present invention have been illustrated in detail, it should be apparent that modifications and improvements may be made to the invention without departing from the spirit and scope of the invention as described in the following claims.

What is claimed is:

1. A developer storing container comprising:

an inner case having an inner opening; and an outer case including:

a first hollow portion including a surrounding wall shaped so as to surround a center axis, in a cross-section said surrounding wall has both ends perpendicular to said center axis, said surrounding wall having an ejection opening through which a developer is ejected, a second hollow portion including plate-shaped first and second outer walls respectively extending from said both ends of said surrounding wall and a third outer wall disposed between said first and second outer walls, and grip portions disposed on said first and second outer walls, said grip portions protruding in an outward direction from said first and second outer walls, wherein said surrounding wall extends from one of said both ends to the other of said both ends at an angle greater than or equal to 180 degrees with respect to said center axis, and an entire outer surface of said surrounding wall constitutes a part of an outer surface of said outer case, said inner case being rotatably disposed in said first hollow portion and contacting an inner surface of said surrounding wall, said inner opening facing said ejection opening when said inner case is in a predetermined rotational position, said inner case including a shutter member that rotates so as to open and close said ejection opening, and a sealing member for sealing said ejection opening and disposed on the shutter member so as to rotate with the shutter member, further wherein in response to a sufficient pressure being applied to said grip portions, said grip portions, said first outer wall and said second outer wall each deform inwardly towards an interior of said developer storing container so as to cause said shutter member to move towards said ejection opening and thereby cause said sealing member to be pressed against said outer case.

2. The developer storing container according to claim 1, wherein said first and second outer walls extend from said both ends of said surrounding wall in a direction in which a distance between said first and second outer walls increases.

3. The developer storing container according to claim 1, wherein an agitation member is disposed in said first hollow portion, and said agitation member has a rotation axis aligned with said center axis.

4. The developer storing container according to claim 1, wherein said ejection opening includes a first and a second opening that are formed with a connection rib disposed therebetween.

5. The developer storing container according to claim 1, wherein said ejection opening has a length in a longitudinal direction which is less than or equal to ½ of a length of said developer storing container in the longitudinal direction.

6. An image forming apparatus comprising said developer storing container according to claim 1.

7. The image forming apparatus according to claim 6, wherein each of said first and second outer walls is inclined at an angle greater than or equal to 50 degrees with respect to the horizontal direction.

8. The developer storing container according to claim 1, wherein a maximum distance between said first and second outer walls is larger than a maximum outer diameter of said first hollow portion.

9. The developer storing container according to claim 8, wherein said grip portions are provided at portions of said first and second outer walls having said maximum distance therebetween.

10. The developer storing container according to claim 1, wherein the grip portions include ribs or recesses.

11. The developer storing container according to claim 1, wherein the grip portions include a first grip portion contacting the first outer wall and a second grip portion contacting said second outer wall, said first grip portion being disposed a different distance from said first hollow portion than said second grip portion.

12. The developer storing container according to claim 1, wherein the grip portions include a first grip portion contacting the first outer wall and a second grip portion contacting the second outer wall, the first and second grip portions having different shapes and being curved inwardly towards the interior of the developer storing container.

13. A developer storing container comprising:

a first storing portion in which a developer can be stored;

a first surrounding wall surrounding said first storing portion and having a substantially uniform cross-section, said first surrounding wall having an ejection opening through which said developer is ejected;

a second storing portion in Which said developer can be stored, said second storing portion being connected to said first storing portion;

a second surrounding wall surrounding said second storing portion and having a substantially uniform cross-section, wherein at a connecting portion between said first storing portion and said second storing portion, said first surrounding wall and said second surrounding wall are constricted inwardly;

grip portions disposed on said second surrounding wall, said grip portions protruding in an outward direction from said second surrounding wall;

a shutter disposed so as to open and close said ejection opening; and a sealing member for sealing said ejection opening and disposed on said shutter so as to rotate with said shutter, and wherein in response to a sufficient pressure being applied to said grip portions, said grip portions and said second surrounding wall each deforms inwardly towards an interior of said developer storing container so as to cause said shutter to move towards said ejection opening and thereby cause said sealing member to be pressed against said first surrounding wall.

14. The developer storing container according to claim 13, wherein said ejection opening includes a first and a second opening that are formed with a connection rib disposed therebetween.

15. The developer storing container according to claim 13, wherein said ejection opening has a length in a longitudinal direction which is less than or equal to ½ of a length of said developer storing container in the longitudinal direction.

16. The developer storing container according to claim 13, wherein said first storing portion has an arc-shaped cross-section, and wherein said shutter is arc-shaped, and is slidable along an inner surface of said first storing portion.

17. An image forming apparatus comprising said developer storing container according to claim 13.

18. The developer storing container according to claim 13, wherein the second surrounding wall includes first and second outer walls each having the grip portions disposed thereupon, a maximum distance between said first and second outer walls being larger than a maximum outer diameter of said first storing portion.

19. The developer storing container according to claim 18, wherein said grip portions are provided at portions of said first and second outer walls having said maximum distance therebetween.

20. The developer storing container according to claim 13, wherein the grip portions includes ribs or recesses.

21. The developer storing container according to claim 13, wherein second surrounding wall includes first and second outer walls, further wherein the grip portions include a first grip portion contacting the first outer wall and a second grip portion contacting the second outer wall, said first grip portion being disposed a different distance from the first storing portion than said second grip portion.

22. The developer storing container according to claim 13, wherein the second surrounding wall includes first and second outer walls, further wherein the grip portions include a first grip portion contacting the first outer wall and a second grip portion contacting the second outer wall, the first and second grip portions having different shapes and being curved inwardly towards the interior of the developer storing container.

* * * * *